US007056172B2

(12) United States Patent
Bernier

(10) Patent No.: US 7,056,172 B2
(45) Date of Patent: Jun. 6, 2006

(54) ENGINE COVER WITH AIR INTAKE SYSTEM FOR WATERCRAFT

(75) Inventor: Martin Bernier, St-François-Xavier de Brompton (CA)

(73) Assignee: Bombardier Recreational Products Inc., Walcourt (CA)

( * ) Notice: Subject to any disclaimer, the term of this patent is extended or adjusted under 35 U.S.C. 154(b) by 0 days.

(21) Appl. No.: 10/913,314

(22) Filed: Aug. 9, 2004

(65) Prior Publication Data

US 2005/0042948 A1 Feb. 24, 2005

Related U.S. Application Data

(60) Provisional application No. 60/493,002, filed on Aug. 7, 2003.

(51) Int. Cl.
*B63B 35/73* (2006.01)

(52) U.S. Cl. ..... 440/88 A

(58) Field of Classification Search ..... 114/55.51, 114/55.53; 440/88 A

See application file for complete search history.

(56) References Cited

U.S. PATENT DOCUMENTS 5,181,870 A * 1/1993 Arai et al. ..... 440/77
5,735,229 A * 4/1998 House et al. ..... 114/363
6,139,381 A * 10/2000 Suzuki et al. ..... 440/88 A

* cited by examiner

*Primary Examiner*—Stephen Avila
(74) *Attorney, Agent, or Firm*—Osler, Hoskin & Harcourt LLP

(57) ABSTRACT

A watercraft comprising a hull and a deck supported by the hull, so as to define a cavity therebetween. The deck has an opening to access an engine compartment in the cavity. An engine is provided in the engine compartment. An engine cover is displaceable between an opened position, remote from the opening in the deck to allow access to the engine, and a closed position, closing the opening. The engine cover has a first surface exposed when the engine cover is in the closed position, a second surface unexposed when the engine cover is in the closed position, a thickness dimension between the first surface and the second surface, an air conduit in the thickness dimension. The air conduit has an inlet end in the first surface and an outlet end in the second surface. The outlet end is in fluid communication with an air intake of the engine.

13 Claims, 6 Drawing Sheets

ENGINE COVER WITH AIR INTAKE SYSTEM FOR WATERCRAFT

CROSS REFERENCE TO OTHER APPLICATION

This nonprovisional application claims priority on U.S. provisional application Ser. No. 60/493,002, filed Aug. 7, 2003, and titled "Engine Cover with Air Intake System for Watercraft", which is incorporated herein by reference.

BACKGROUND OF THE INVENTION

1. Field of the Invention

The present invention generally relates to watercraft and, more particularly, to an air intake system associated with an engine cover of jet-powered watercraft.

2. Background Art

Personal watercraft are common place in the nautical industry. The personal watercraft consists of a versatile jet-powered nautical vehicle for one or more rider, that is used for touring and as a nautical sport. In the latter use, where stand-up type personal watercraft are often used, the personal watercraft is configured to be nimbler.

The personal watercraft is relatively small when compared to jet-powered watercraft, but nonetheless have similar components, such as the engine and propulsion system, the steering system, etc . . . Therefore, the use of the cavity defined between the deck and the hull must be optimized in order to have sufficient space for all the necessary equipment for the operation of the personal watercraft.

Air intake systems of personal watercraft take up a good portion of the space. As the personal watercraft is adapted for various maneuvers in the water, the air intake systems must be configured so as to prevent water infiltration in the engine. Therefore, the air intake systems of personal watercraft have an air inlet, conduits that communicate the air inlet to the engine compartment, with the conduits being in chicane configurations to prevent water from reaching the engine.

It would be desirable to provide air intake systems that use reduced volume within the cavity of the watercraft, while maintaining suitable chicane configurations to substantially prevent water from passing therethrough to reach the engine.

SUMMARY OF INVENTION

It is therefore an aim of the present invention to provide an engine cover having an air intake system.

It is a further aim of the present invention that the engine cover is readily assembled to form the air intake system.

Therefore, in accordance with the present invention, there is provided a watercraft comprising: a hull; a deck supported by the hull, so as to define a cavity therebetween, the deck having an opening to access an engine compartment in the cavity; an engine in the engine compartment; and an engine cover being displaceable between an opened position, remote from the opening in the deck to allow access to the engine, and a closed position, closing the opening, the engine cover having a first surface exposed when the engine cover is in the closed position, a second surface unexposed when the engine cover is in the closed position, a thickness dimension between the first surface and the second surface, an air conduit in the thickness dimension, the air conduit having an inlet end in the first surface and an outlet end in the second surface, the outlet end being in fluid communication with the engine compartment.

Further in accordance with the present invention, there is provided an engine cover for a watercraft, comprising: a first surface; a second surface adapted to be resting on a deck of the watercraft such that the engine cover is supported by the deck of the watercraft to cover an engine access opening; a thickness dimension between the first surface and the second surface; an air conduit in the thickness dimension, the air conduit having an inlet end in the first surface and an outlet end in the second surface, the outlet end being adapted to be in fluid communication with an an engine compartment of the watercraft.

BRIEF DESCRIPTION OF THE DRAWINGS

Having thus generally described the nature of the invention, reference will now be made to the accompanying drawings, showing by way of illustration a preferred embodiment thereof and in which.

Figure 1:
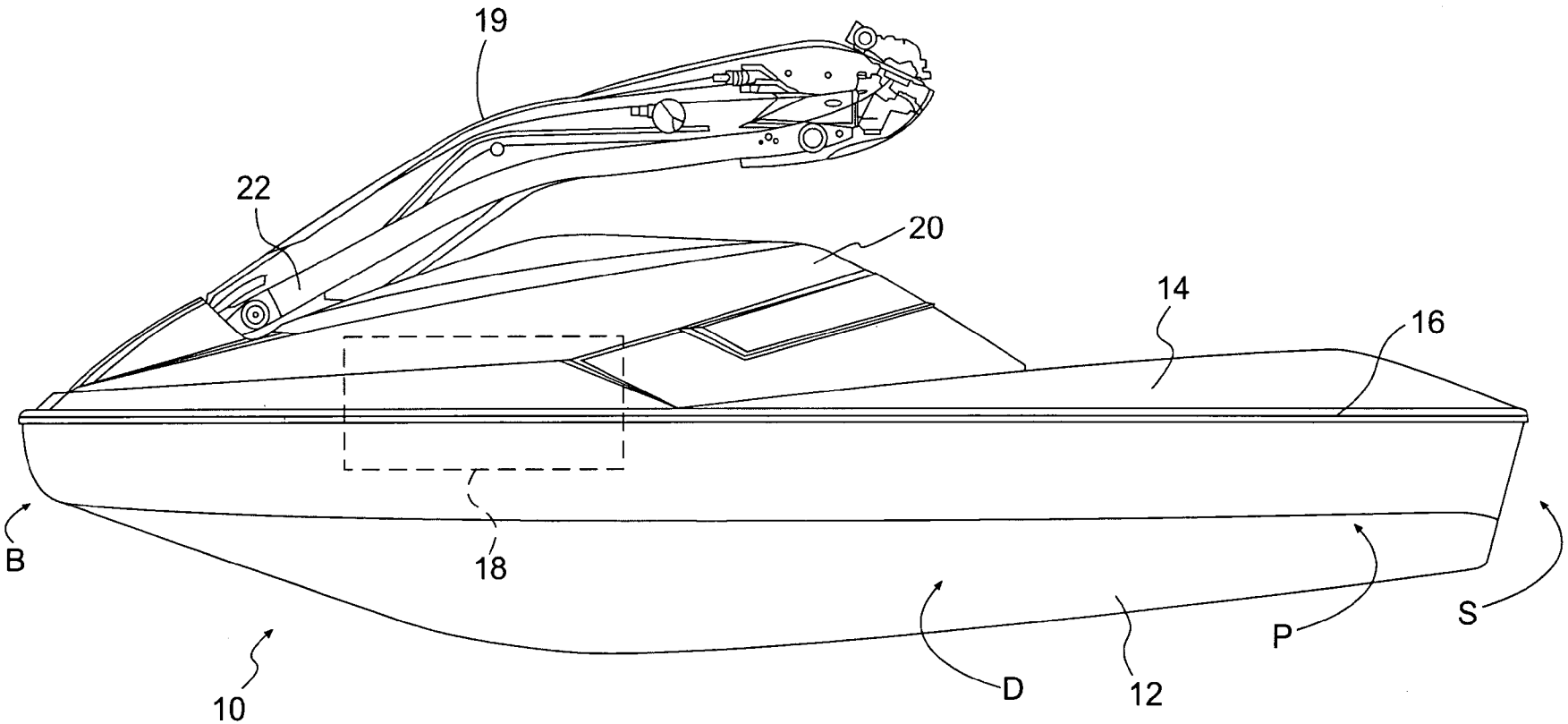
FIG. 1 is a port side elevation view of a personal watercraft having an engine cover in accordance with the present invention.

An annex of figures is provided following FIGS. 1 to 6.

DESCRIPTION OF THE PREFERRED EMBODIMENTS

Referring to the drawings and, more particularly to FIG. 1, a personal watercraft is generally shown at 10 (hereinafter PWC 10). The PWC 10 is configured to allow stand-up type riding, but may also be a straddle-type personal watercraft. The PWC 10 has a bow B, a stern S, a port side P and a starboard side D. The PWC 10 has two main parts, namely a hull 12 and a deck 14. The hull 12 buoyantly supports the personal watercraft 10 in a body of water. The hull 12 and the deck 14 are sealed together at bond line 16. The space between the hull 12 and the deck 14 forms a cavity that accommodates an engine 18, as well as other components such as, non exhaustively, a gas tank, an electrical system (battery, electronic control unit, drive shaft, etc.), which form, together with the engine 18, the propulsion system of the PWC 10.

The PWC 10 has a steering system that has an exposed portion 19 connected to the deck 14 at the bow B. The steering system is provided for the steering of the PWC 10. An engine cover 20 is generally positioned above the engine 18, and is openable so as to provide access to the engine 18. For instance, a foremost edge of the engine cover 20 may be hinged to the deck 14, for opening the engine cover 20.

The engine cover 20 defines an air intake system in accordance with the present invention. More specifically, the engine cover 20 has air inlets and conduits in a chicane configuration to connect the air inlets to the engine 18 compartment. Accordingly, beyond the air conduits of the engine cover 20, air conduits can go relatively directly to the engine 18, i.e., without further chicanes.

Figure 2:
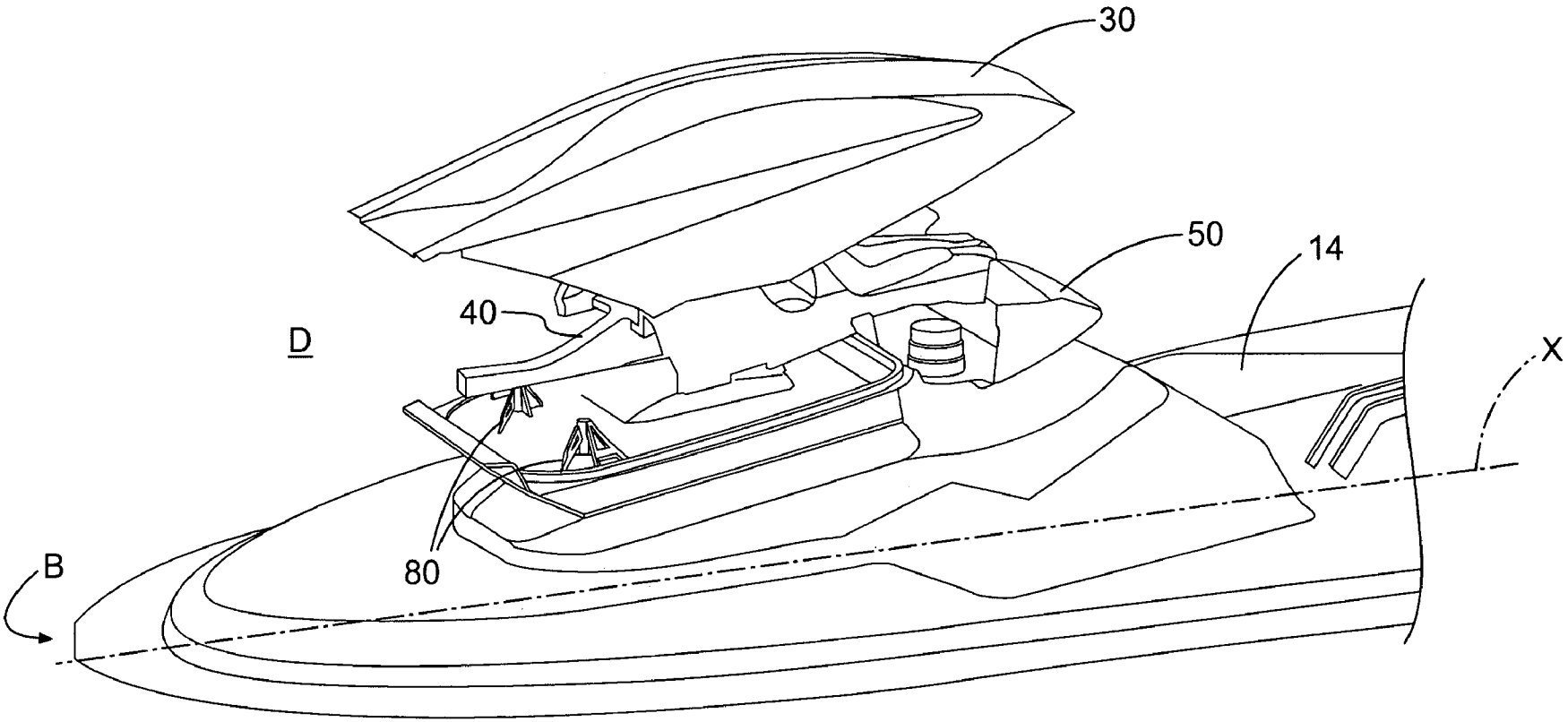
FIG. 2 is an exploded view of the engine cover with respect to a deck of the personal watercraft, taken from a port side and bow standpoint.
Figure 3:
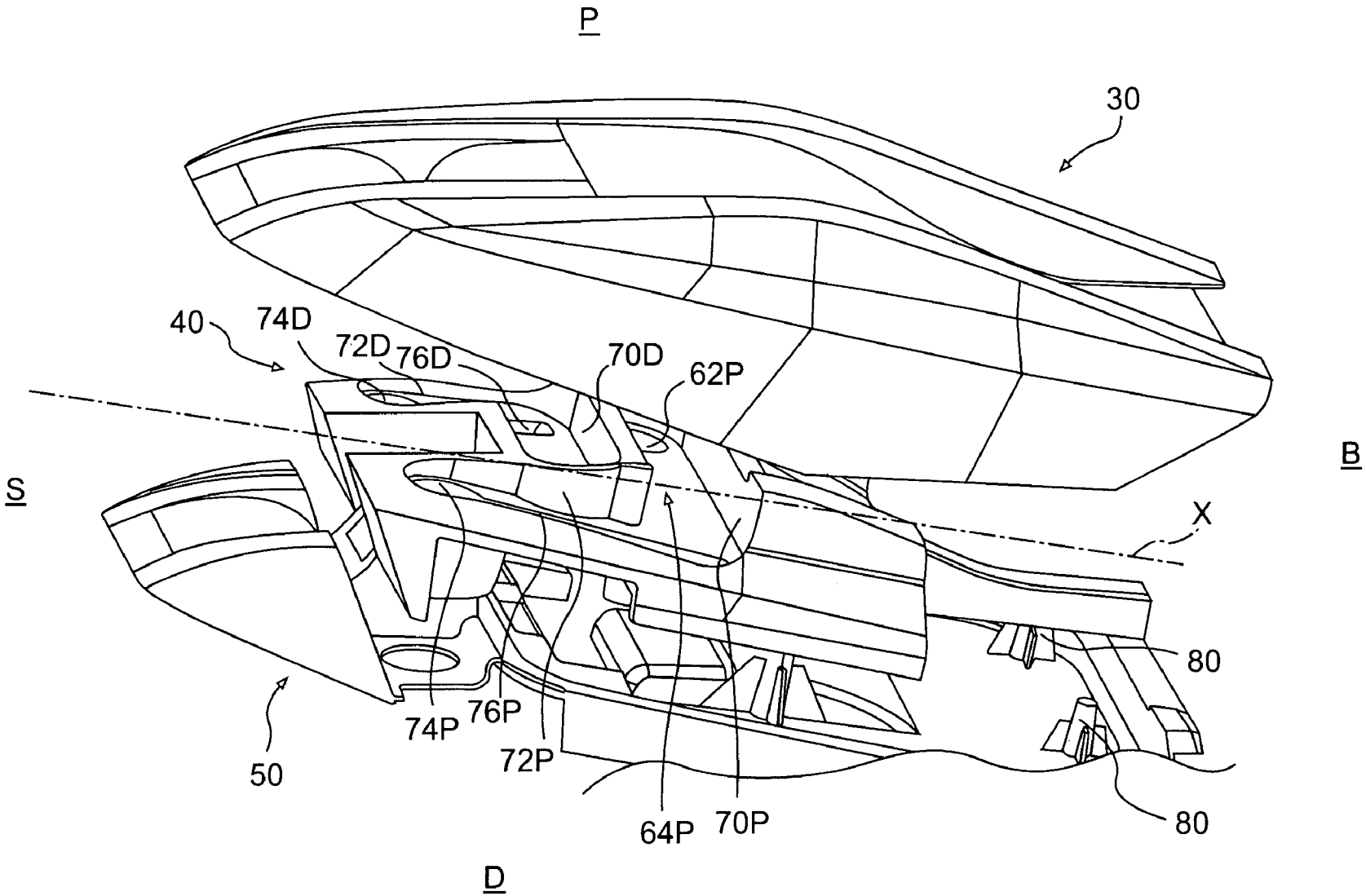
FIG. 3 is an exploded view of the engine cover of the present invention, taken from a starboard side standpoint.

Referring concurrently to FIGS. 2 and 3, the engine cover 20 has an outer skin 30, a core 40 and an inner skin 50. For reference purposes, a central longitudinal axis of the PWC 10 will be illustrated at X in the Figs. The central longitudinal axis X separates the PWC 10 in the port side P and the starboard side D.

The outer skin 30 is the exposed portion of the engine cover 20 when the engine cover 20 is in a closed position onto the deck 14 of the PWC 10. As will be detailed hereinafter, the outer skin 30 has air inlets, and outlet gutters, such that air reaching the air inlets may be directed out of the engine cover 30.

The core 40 is sandwiched between the outer skin 30 and the inner skin 50. As will detailed hereinafter, the core 40 defines the chicane configuration conduits with inner surfaces of the outer skin 30 and the inner skin 50.

The inner skin 50 supports the outer skin 30 and the core 40. As will be detailed hereinafter, the inner skin 50 ensures the water tightness between the engine cover 20 and the deck 14. The inner skin 50 is interconnected to the outer skin 30, and ensures the fluid communication between the engine cover 20 and the air hoses of the engine 18.

Air Inlets

Figure 4:
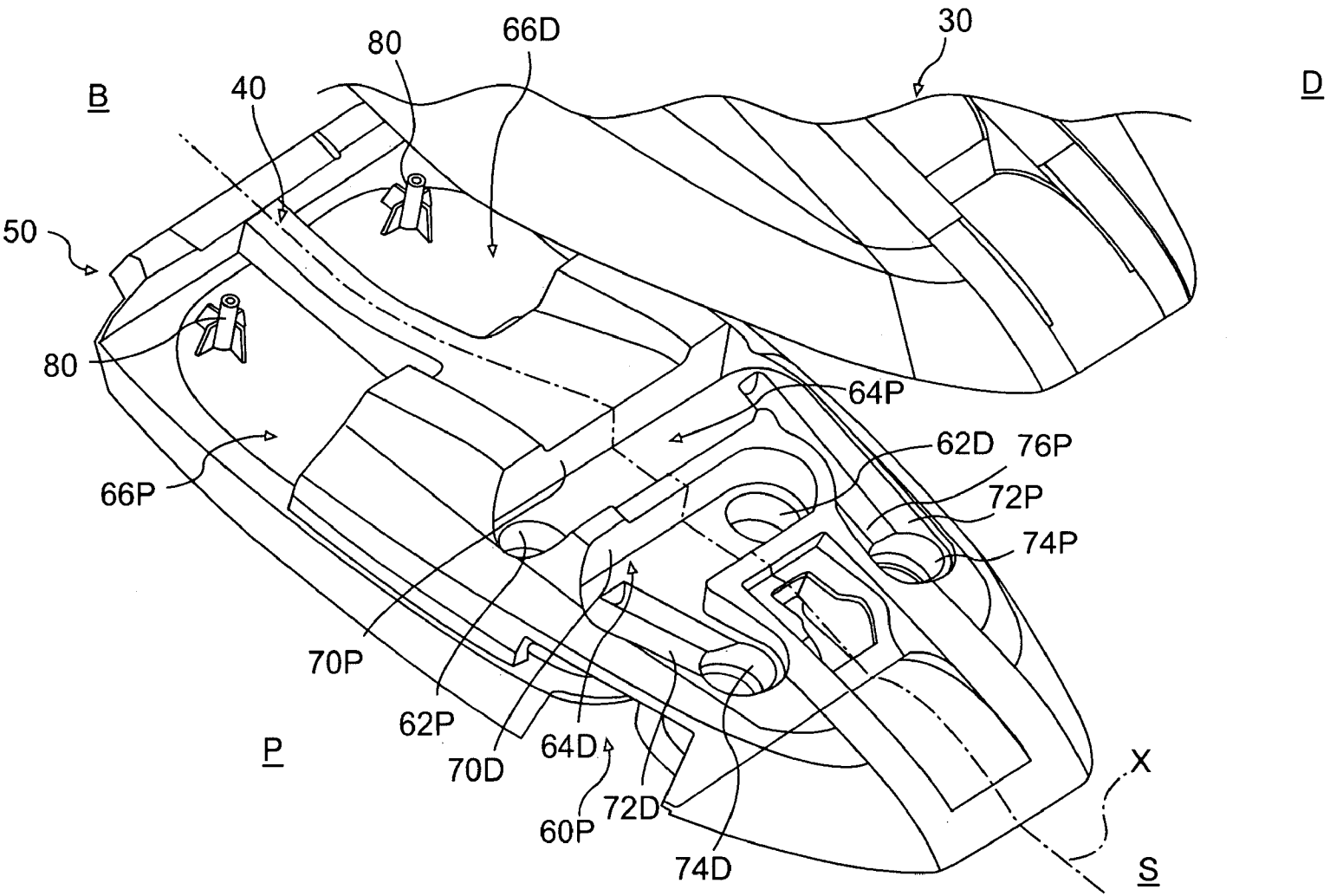
FIG. 4 is a perspective view of the engine cover, with an outer skin in an exploded view with respect to a core and an inner skin, from a port side standpoint.

Referring to FIG. 4, the core 40 is shown positioned onto the inner skin 50. Reference letters B and S are shown to illustrate how the engine cover 20 is positioned on the PWC. A port inlet 60P is defined between an underside of the core 40 and an upper side of the inner skin 50. The port inlet 60P remains exposed when the outer skin 30 is mounted onto the core 40/inner skin 50 combination. The port inlet 60P communicates with an inlet cylindrical passage 62P of a chicane conduit extending from the underside of the core 40 to an upperside thereof. The inlet cylindrical passage 62P emerges into a chicane conduit channel 64P, which will be described in further detail hereinafter.

To increase the air intake through the engine cover 20, a similar inlet configuration is provided on the starboard side D of the engine cover 20. More specifically, referring to FIG. 5, the engine cover 20 has a starboard inlet 60D defined between the underside of the core 40 and the upper side of the inner skin 50. The port inlet 60D remains exposed when the outer skin 30 is mounted onto the core 40/inner skin 50 combination. The starboard inlet 60D communicates with an inlet cylindrical passage 62D extending from the underside of the core 40 to an upperside thereof. The inlet cylindrical passage 62D emerges into a chicane conduit channel 64D, which will be described in further detail hereinafter. Advantageously, the chicane conduit channels 64D and 64P are above the inlets 60D and 60P, thereby providing an obstacle against water reaching the chicane conduit channels 64D and 64P.

Outlet Gutters

Figure 5:
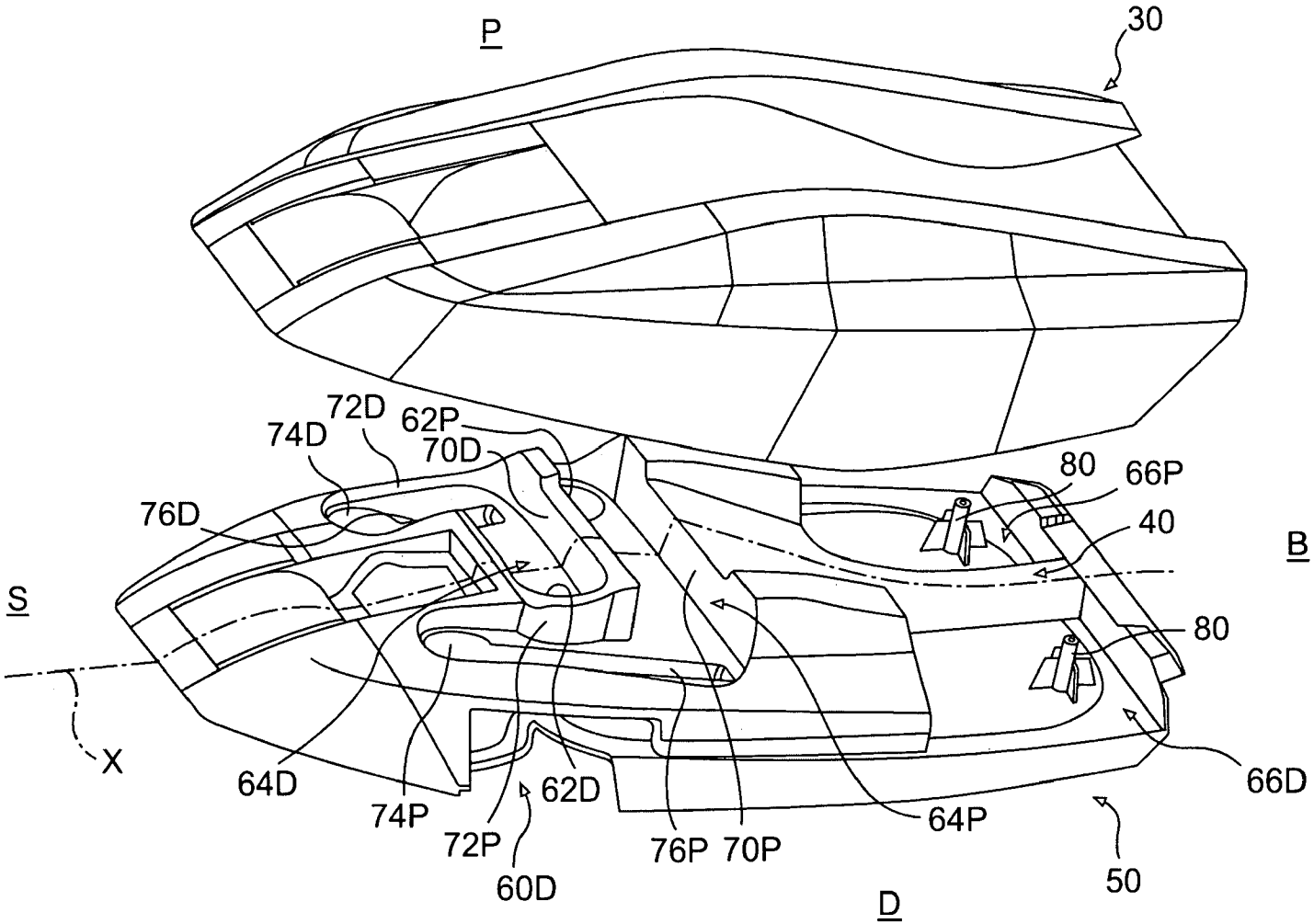
FIG. 5 is a perspective view of the engine cover of FIG. 4, taken from a starboard side standpoint.

Referring concurrently to FIGS. 4 and 5, outlet gutters 66D and 66P are positioned forward of the air inlets 60D and 60P, respectively. The outlet gutters 66D and 66P are respectively defined by cutouts 68D and 68P (FIG. 6) in the core 40, and by inner surfaces of the outer skin 30 and the inner skin 50.

Figure 6:
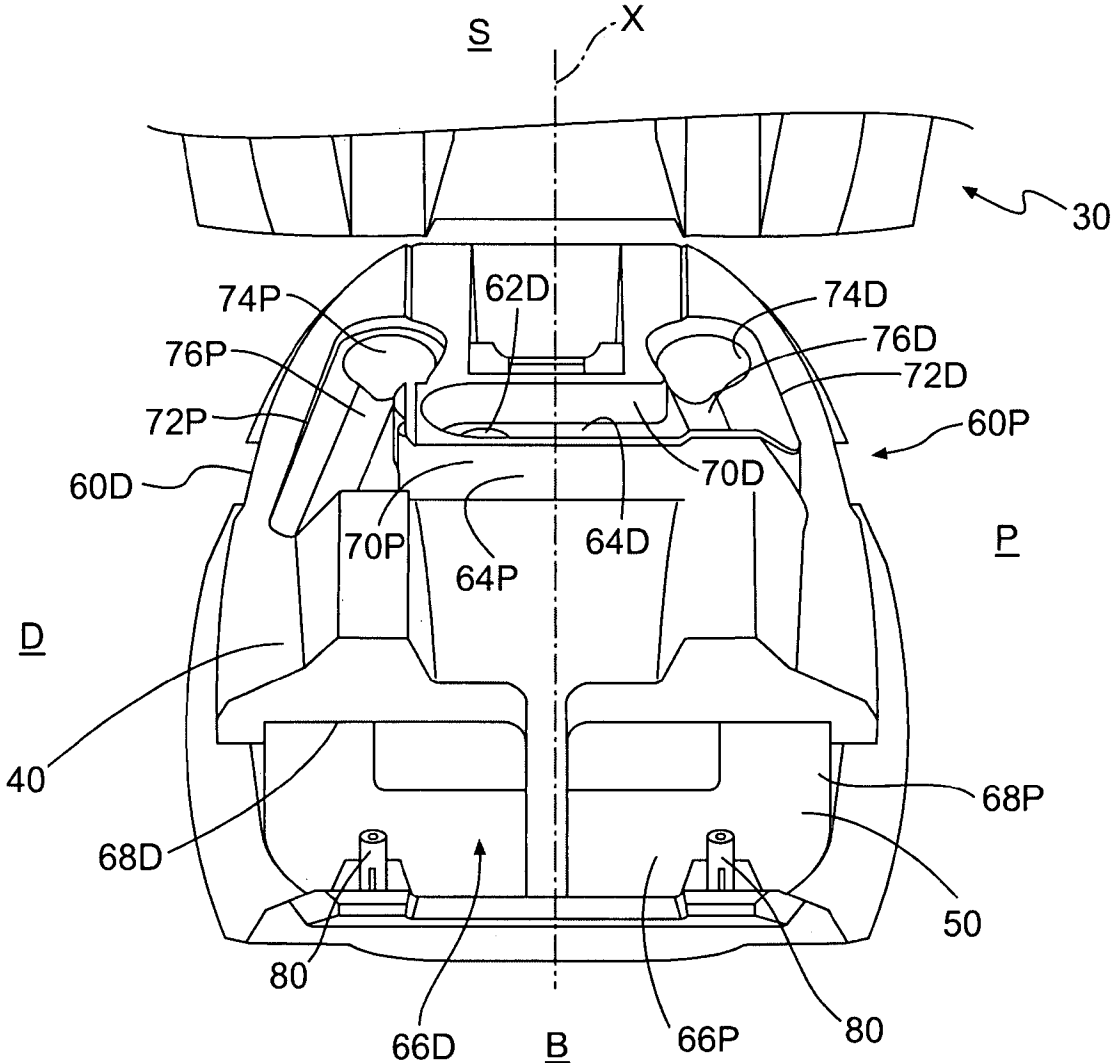
FIG. 6 is an elevation view of the engine cover of FIG. 4, taken from a bow standpoint.

The outlet gutters 66D and 66P are in fluid communication with the inlets 60D and 60P, respectively, but are slightly below the latters, such that water entering in the inlets 60D and/or 60P will flow toward the respective outlet gutters 66D and/or 66P. As seen in FIG. 6, plenums 68D and 68P ensure the fluid communication between the inlets 60D and 60P, respectively, and the gutter portions 66D and 66P. The plenums 68D and 68P are defined by channels formed in the core 40 and an inner surface of the inner skin 50.

When the outer skin 30 is mounted onto the inner skin 50, there is a gap between the periphery of the outer skin 30 and the periphery of the outlet gutters 66D and 66P, such that water in the outlet gutters 66D and 66P will be drained out of the engine cover 20 upon reaching the outlet gutters 66D and 66P.

Chicane Conduits

Referring to FIG. 4, the chicane conduit channel 64P is in fluid communication with the inlet cylindrical passage 62P. The chicane conduit channel 64P is formed into the core 40. When the outer skin 30 is laid onto the core 40 (as in FIG. 1), an inner surface of the outer skin 30 contacts the core 40 at the periphery of the chicane conduit channel 64P, such that a chicane conduit is defined therebetween. Small ribs extending from the channel contour nay be added to ensure better sealing between the channel and the outer skin 30.

The chicane conduit channel 64P has a transverse portion 70P, and a longitudinal portion 72P. The transverse portion 70P is transversely positioned with respect to the central longitudinal axis X of the PWC 10, so as to overlap same. The transverse portion 70P is connected at an inlet end to the inlet cylindrical passage 62P, and at a free end to the longitudinal portion 72P.

The longitudinal portion 72P is generally parallel to the central longitudinal axis X of the PWC 10. A free end of the longitudinal portion 72P is connected to an outlet cylindrical passage 74P of the chicane conduit, formed concurrently by the core 40 and the inner skin 50. The outlet cylindrical passage 74P is in fluid communication with an air intake (not shown) of the engine 18 (FIG. 1), such that air can be supplied to the engine 18.

Referring to FIG. 4, a groove 76P is defined in the longitudinal portion 72P. The groove 76P is optionally provided to increase a cross-section of the chicane conduit. Minimal intake cross-sections are regulated, and the groove 76P represents a simple way to increase the intake cross-section of the chicane conduit of the engine cover 20.

Similarly to the chicane conduit channel 64P, the chicane conduit channel 64D forms a chicane conduit when the outer skin 30 or the rib (not shown) is laid onto the core 40. The inner surface of the outer skin 30 contacts the core 40 at the periphery of the chicane conduit channel 64P, thereby together forming the chicane conduit channel.

The chicane conduit channel 64D has a transverse portion 70D, overlapping the central longitudinal axis X of the PWC 10, and a longitudinal portion 70P. The transverse portion 70D is connected at an inlet end to the inlet cylindrical passage 62D, and at a free end to the longitudinal portion 72D.

The longitudinal portion 72D is generally parallel to the central longitudinal axis X of the PWC 10. A free end of the longitudinal portion 72D is connected to an outlet cylindrical passage 74D of the chicane conduit, formed concurrently by the core 40 and the inner skin 50. The outlet cylindrical passage 74D is in fluid communication with another air intake (not shown) of the engine 18 (FIG. 1), such that air can be supplied to the engine 18. A groove 76D is provided to increase a cross-section of the chicane conduit.

As mentioned above, the chicane conduit channels 64D and 64P have the transverse portions 70D and 70P that overlap the central longitudinal axis X. In the event that the PWC 10 has tilted on the side and thus has one of its sides (starboard D or port P) submerged, water entering the chicane conduit will not reach the longitudinal portions 72D or 72P, because of the transverse portions 70D and 70P.

Moreover, the transverse portions 70D and 70P are slanted toward the respective inlets 60D and 60P with respect to a horizon of the PWC 10 in a normal floating position of the PWC 10 (i.e., with the deck 14 being generally horizontal). Accordingly, once the PWC 10 is returned to its normal floating position after being laterally submerged, water drains out of the chicane conduit through the inlets 60D and 60P, because of the slant in the transverse portions 70D and 70P, and the fact that the inlets 60D and 60P are positioned below the transverse portions 70D and 70P. Also, the transverse portions 70D and 70P are positioned forward of the inlets 60D and 60P, respectively, thereby forming another obstacle against water penetration in the chicane conduits.

Alternatively, the chicane conduit, including the inlet cylindrical passages 62D and 62P and the outlet cylindrical passages 74D and 74P, may be provided with check valve mechanisms to prevent water from reaching the air intakes of the engine 18 (FIG. 1).

The outlet cylindrical passages 74D and 74P will be connected to the air intakes of the engine 18 (FIG. 1). As the engine cover 20 is typically openable to reach the engine 18, it is preferred to provide mating configurations between the outlet cylindrical passages 74D and 74P, and respective ones of the air intakes to the engine compartment, such that the outlet cylindrical passages 74D and 74P will sealingly connect with the air intakes when the engine cover 20 goes from an opened position to the closed position.

Construction

It is contemplated to provide an engine cover, in accordance with the present invention, composed of conduits in a hollow shell. For instance, the outer skin 30 could be used with various conduits on an inner surface thereof, rather than with the core 40 and the inner skin 50. These various conduits would be connected to the air intakes of the engine 18 (FIG. 1), and would be positioned in suitable chicane configuration to prevent water from reaching the air intakes.

The three-layer configuration shown in FIGS. 2 to 6 is relatively simple to assemble. As the various conduits are preformed in the outer skin 30, the core 40 and the inner skin 50, the interconnection of the outer skin 30 and the inner skin 50, with the core 40 therebetween, is the only step required to form a chicane configuration for the engine cover 20.

The core 40 preferably consists of a foamy plastic, such as an expandable plastic. For instance, EPP (expandable polypropylene) or EPE (expandable polyethylene) are resilient, and are thus advantageously used in the engine cover 20 of the present invention. More precisely, the resilience of these materials can be used to isolate the various components of the engine cover 20 formed by the interconnection between the three layers. For example, the core 40 can be molded so as to be of slightly greater surface than the inner surface of the outer skin 30 that will be laid thereupon. Accordingly, when the outer skin 30 is installed onto core 40, the latter is slightly squeezed by its exceeding surface with respect to the inner surface of the outer skin 30. This squeeze will serve as a seal between the chicane conduits defined by the connection of the core 40 to the outer skin 30. Also, expandable polymers increase the buoyancy of the PWC 10, especially in the event that the PWC 10 is flipped sideways.

On the other hand, the outer skin 30 and the inner skin 50 consist of a more rigid material (e.g., fiberglass, higher density plastics). In addition to cooperating with the resilient core 40 in sealingly separating the conduits (as described above), the outer skin 30 and the inner skin 50 have structural functions. The outer skin 30 is the portion of the engine cover 20 that is exposed, and acts as a shell. The inner skin 50 bears the weight of the engine cover 20 when the latter is in its closed position on the deck 14.

The outer skin 30 and the inner skin 50 are preferably molded. Complementary connectors are provided in the outer skin 30 and the inner skin 50 for the interconnection therebetween. For instance, referring to FIGS. 2 to 5, connector supports 80 protrude upwardly from the inner skin 50. The connector supports 80 each enclose a tapped tube, such that threaded fasteners can be used to releasably fix the outer skin 30 to the inner skin 50.

It is pointed out that, although the above described embodiment has two separate conduits, more conduits may be provided for supplying the necessary air to the engine 18.

Although the engine cover 20 has been described for use with a personal watercraft such as PWC 10, it is contemplated to use an engine cover in accordance with the present invention on a jet-powered watercraft of greater size. Cavity space optimization is not as important a design factor for such watercraft. However, the engine cover 20 of the present invention is also convenient for such watercraft.

It is within the ambit of the present invention to cover any obvious modifications of the embodiments described herein, provided such modifications fall within the scope of the appended claims.

The invention claimed is:

1. A watercraft comprising:

a hull;

a deck supported by the hull, so as to define a cavity therebetween, the deck having an opening to access an engine compartment in the cavity;

an engine in the engine compartment; and an engine cover disposed on the deck, the engine cover being displaceable between an opened position, remote from the opening in the deck to allow access to the engine, and a closed position, closing the opening, the engine cover having an outer skin, an inner skin, and a core therebetween, the engine cover having a first air conduit defined therein, at least in part in the core, to allow fluid communication between the engine compartment and an ambient environment of the watercraft, the engine cover having a second air conduit defined therein, at least in part in the core and distinct from the air conduit, and each of the first air conduit and the second air conduit traversing a central longitudinal axis of the watercraft.

2. The watercraft according to claim 1, wherein the first air conduit includes a channel defined in the core and at least one of the outer skin and the inner skin.

3. The watercraft according to claim 1, wherein at least one of the first and second air conduits is a channel defined in the outer skin, the inner skin, and the core.

4. The watercraft according to claim 1, wherein the core comprises an expandable polymer.

5. The watercraft according to claim 1, wherein the engine cover further comprises a gutter portion in fluid communication with at least one of the first and second air conduits such that water entering the-at least one of the first and second air conduits drains to the gutter portion and out of the watercraft.

6. The watercraft according to claim 1, wherein at least one of the inner skin, the outer skin and the core is molded.

7. The watercraft according to claim 1, wherein at least one of the first and second air conduits has an upstream portion positioned rearwardly of a downstream portion thereof.

8. The watercraft according to claim 1, wherein at least one of the first and second air conduits has an inlet end in fluid communication with the ambient environment and an outlet end in fluid communication with the engine compartment, and the at least one air conduit is inclined upwardly from the inlet end to the outlet end.

9. An engine cover suitable to be disposed on the deck of a watercraft, the engine cover having an outer skin, an inner skin, and a core therebetween, the engine cover having an air conduit defined therein, at least in part in the core, to allow fluid communication through the cover, the engine cover having a second air conduit defined therein, at least in part in the core and distinct from the air conduit, and each of the air conduit and the second air conduit traversing a central longitudinal axis of the engine cover, wherein at least one of the first and second air conduits is a channel defined in the outer skin, the inner skin, and the core.

10. The engine cover according to claim 9, wherein the core comprises an expandable polymer.

11. The engine cover according to claim 9, wherein at least one of the inner skin, the outer skin and the core is molded.

12. The engine cover according to claim 9, wherein at least one of the first and second air conduits has an upstream portion positioned rearwardly of a downstream portion thereof.

13. The engine cover according to claim 9, wherein at leaste one of the first and second air conduits has an inlet end in and an outlet end, and the at least one air conduit is inclined upwardly from the inlet end to the outlet end.

* * * * *